US006132571A

United States Patent [19]

Bell

[11] Patent Number: 6,132,571

[45] Date of Patent: Oct. 17, 2000

[54] SYSTEM FOR PREDICTING IMPENDING ANODE EFFECTS IN ALUMINUM CELLS

[75] Inventor: David G. Bell, Nine Mile Falls, Wash.

[73] Assignee: Kaiser Aluminum and Chemical Corporation, Pleasanton, Calif.

[21] Appl. No.: 09/070,223

[22] Filed: Apr. 30, 1998

[51] Int. Cl.[7] ..... C25C 3/00

[52] U.S. Cl. ..... 204/243.1

[58] Field of Search ..... 204/242, 243.1, 204/155–914; 205/372

[56] References Cited

U.S. PATENT DOCUMENTS

| | | | |
|---|---|---|---|
| 3,578,569 | 5/1971 | Lewis | 204/243.1 X |
| 4,230,540 | 10/1980 | Archer et al. | 205/372 |
| 4,425,201 | 1/1984 | Wilson et al. | 204/67 |

FOREIGN PATENT DOCUMENTS

| | | | |
|---|---|---|---|
| 526684 | 4/1974 | U.S.S.R. | C25C 003/20 |
| 1534099 | 4/1984 | U.S.S.R. | C25C 003/20 |
| 1482982 | 3/1987 | U.S.S.R. | C25C 003/20 |

OTHER PUBLICATIONS

Aralbayeva and Sarychev, "Prediction from Spectral Characteristics Based on the GMDH Algorithm of the Anode Effect in an Aluminum Electrolyzer", 1988, pp. 39–45 no month.

Derwent Publications Ltd, "Aluminum Electrolyzer Anode Effect Predictor—Determines Dorrelation Function Between Smoother Cell Voltage and Voltage Harmonics Intensity", 1989 no month.

Mendel, Jerry M., "Tutorial on Higher–Order Statistics (Spectra) in Signal Processing and System Theory: Theoretical Results and Some Applications", Proc. IEEE 79 (3), pp. 278–305 no date available.

Nikias, Chrysostomos L., et al., "Higher Order Spectra Analysis: A Nonlinear Signal Processing Framework", Prentice–Hall, Englewood Cliffs, NJ, 1993, ISBN 0–13–678210–8 no month available.

Meyer et al. "Anode Effect Prediction." Light Met. (Warrendale, Pa.) 2, 365–70, 1986.

"Prediction of the Anode Effect and It's Role in Process Control of Aluminum Electrolyzers With Self–Baking Anodes," Banyasz. Kohasz. Lapok, Kohasz, 122(2), 78–82, 1989.

Meghlaoui et al., Nueral Networks for Control of Electrolytic Cells. Light Met. 1996, Proc. Int. Symp. 453–65, 1996.

Aralbayeve et al. "Prediction From Spectral Characteristics Based on the GMOH Algorithim of the Anode Effect in an Aluminum Electrolyzer," Sov. J. Autom. Inf. Sci. v. 20, N.6, pp. 39–45, Nov. 1987.

*Primary Examiner*—Donald R. Valentine
*Attorney, Agent, or Firm*—Lee & Hayes, PLLC

[57] ABSTRACT

An aluminum reduction cell system includes a cell controller to monitor and control an associated aluminum reduction cell. The cell controller measures a cell voltage output from the cell and a bus current signal input to the cell, and computes impedance from the measured cell voltage and current. An anode effect predictor is incorporated into the cell controller to predict when the aluminum reduction cell is about to experience an anode effect. The anode effect predictor applies a higher-order statistical function to the cell impedance data to produce a spectrum representative of the cell's behavior. The statistical function is, for example, a third-order coherence function of the impedance data, which is one order higher than a second-order power spectrum. The coherence function captures correlation or interdependence between the samples that make up the power spectrum. The higher-order spectrum exhibits different patterns or "footprints" that change as the cell transitions from steady state to an anode effect condition. The anode effect predictor detects the changing spectrum patterns as a means for determining an oncoming anode effect. When an impending anode effect is detected, the anode effect predictor informs the cell controller, which then takes steps to minimize the impact of an upcoming anode effect.

14 Claims, 10 Drawing Sheets

SYSTEM FOR PREDICTING IMPENDING ANODE EFFECTS IN ALUMINUM CELLS

TECHNICAL FIELD

This invention relates to aluminum reduction cells and to control systems and methods for controlling the aluminum reduction cells. More particularly, this invention relates to system and methods for predicting impending anode effects in the aluminum reduction cells.

BACKGROUND OF THE INVENTION

Aluminum reduction is a process that is difficult to completely automate. There are various reasons for this difficulty. One reason is that the materials used in the process cannot be easily handled with conventional materials handling equipment. Another reason is that it is difficult or impossible to monitor many important variables within the process. As a result, many process conditions must be inferred from a few variables that can be measured.

By way of background, FIG. 1 shows a simplified cross-section of an aluminum reduction cell 20. The reduction cell 20 includes a large thermally insulated container or "pot" 22, insulated with an electrically conductive refractory lining, which forms the cathode 24. Within the pot is a molten mixture 26 of cryolite in which the alumina (aluminum oxide) is dissolved. This liquid layer 26 is commonly referred to as "bath." Sacrificial carbon anodes 28 (one shown) extend into this mixture 26 from above. Pot 22 and a metal pad 30 of molten aluminum form an associated cathode.

A voltage potential is applied between anodes 28 and pot 22, resulting in a large current flow between them and through the bath 26. The magnitude of this current is typically over 60,000 Amperes. The electrical current passing through the alumina mixture 26 converts the alumina into its aluminum and oxygen components by electrolysis. The aluminum drops to the bottom of pot 22, forming the metal pad 30, while the oxygen combines with carbon from anodes 28 and escapes as carbon dioxide gas. As alumina is consumed, more alumina is added to the cell. The carbon dioxide gas is vented away by an overlying hood (not shown).

In order to regulate the aluminum reduction process, it is necessary to control the electrical power in the reduction cell. Typically, electrical current is applied to a "line" of multiple cells arranged in series. Hence, the electrical current passing through an individual cell is a variable that cannot be affected or changed at the cell level. Instead, varying the voltage across the cell regulates electrical power to individual cells. This is accomplished by raising and lowering the anodes relative to the underlying cathode. Raising the anodes increases the distance between the anodes and the cathode, thereby increasing impedance. Since current through the cell is nominally constant, the increased impedance raises the voltage between the anode and the cathode, and thereby increases the overall power in the reduction cell.

During the aluminum reduction process, it is necessary to periodically add (i.e., "feed") alumina into the pot to replace the alumina that has been converted to aluminum. It is important to feed alumina at a proper rate. Too much alumina drastically reduces efficiency. Too little alumina can cause increased impedance, and thus voltage, to rise, eventually causing what is known in the aluminum industry as an "anode effect."

An anode effect occurs when the pot is underfed to the point where the conversion process begins generating fluorocarbon gas bubbles rather than carbon dioxide. These bubbles form a layer of gas of very low electrical conductivity on the bottom of the anodes that increases impedance and thus, voltage and power. The higher power heats up the pot and accelerates the fluorine conversion, thus generating even more fluorine gas and even higher voltage. In a very short time, on the order of milliseconds, this behavior can increase the cell voltage to several times its normal value.

The anode effect can also be explained at the molecular level in terms of ion populations at the surface of the carbon anode. During the aluminum reduction process, oxygen-bearing ions consisting of aluminum, oxygen, and fluorine exist at the anode surface. These anode ions, or "anions", react with the carbon and are consumed. Carbon dioxide and some carbon monoxide are produced as a result. In a normal process, the anions are replaced and the carbon dioxide gas escapes as small bubbles. Replacement anions are transported to the anode surface by convection and diffusion in balance with the electrolytic consumption. The anion transport rates are finite, affected by such phenomena as the electrolyte temperature, the gradient of the electrolyte temperature near the anodes, convective mixing induced by magnetohydrodynamics, and concentration gradients of the relevant ions.

The anode effect occurs when the anion consumption rate exceeds the cumulative transport rates and thus the anions are not replaced fast enough at the anode to continue steady-state operation. The remaining anions are reduced by a reaction of their fluorine component with the carbon, producing a fluorocarbon gas. It is the physical properties of this gas that cause the operational difficulties associated with the anode effect. Specifically, this fluorocarbon gas wets the anode surface, resulting in larger bubbles than those formed by the carbon dioxide. Since the fluorocarbon gas is also dielectric, the larger bubbles effectively insulate the covered portion of the anode surface, so that the covered portion is not electrolytically active. It is noted that the transition from steady-state electrolysis to the anion depletion near the anode that produces the anode effect occurs gradually due to the finite rates of the processes; once the production of fluorocarbon gas begins, the rise in cell impedance occurs rapidly.

While it is considered normal for a pot to occasionally exhibit anode effects, it is nonetheless desirable to reduce the number of anode effects and also to reduce the magnitude of voltage increase during any single anode effect. Reducing anode effects improves operating efficiency and minimizes the quantity of fluorocarbons generated.

There are different strategies for controlling and terminating anode effects. A primary strategy is to accelerate alumina feedings. Another strategy is to rapidly lower the anodes to dispel the gas bubbles, and then raise the anodes back to their proper level. In extreme cases, gas bubbles are dispelled by shoving "green" tree branches beneath the anodes.

Ideally, it would be desirable to predict when an anode effect is about to occur. Unfortunately, this simple premise has heretofore been impossible to implement. One early attempt to predict impending anode effects was based on movement of cell impedance. When the cell impedance increased by a certain percentage, the alumina concentration was known to have decreased and hence the technique assumed that the cell was on the way to experiencing an anode effect. The operator would then try to accelerate the alumina feed to prevent the anode effect. However, this technique proved not to be a very effective prediction tool, especially in high current density cells, and thus it is not in use today.

Accordingly, there remains a need for a system and method that more accurately predicts impending anode effects.

SUMMARY OF THE INVENTION

This invention concerns a system and method for predicting impending anode effects in an aluminum reduction cell. The system includes a cell controller to monitor and control the operation of an aluminum reduction cell. The cell controller receives an analog cell voltage signal from the cell and an analog line current signal from a current bus that carries current to an array of cells. The cell controller converts the analog signals to digital data, stores the data in memory, and calculates impedance data from the measured cell voltage and current data.

An anode effect predictor is incorporated into the cell controller to predict when the aluminum reduction cell is about to experience an anode effect. The anode effect predictor generates a higher-order statistical function of the cell impedance signal, or alternatively of the cell voltage signal, which results in a higher-order spectrum when transformed to the frequency domain. These higher-order spectra include features that clearly identify certain operating states of the aluminum reduction cell.

The statistical function is, for example, a third-order coherence function of the impedance data, which is one order higher than a second-order power spectrum.

The resulting higher-order spectra exhibit different patterns that change as the cell transitions from steady state to an anode effect condition. The anode effect predictor detects the changes in the spectra as a means for determining an oncoming anode effect. When an impending anode effect is detected, the anode effect predictor informs the cell controller, which then takes steps to minimize the impact of an upcoming anode effect.

DETAILED DESCRIPTION OF THE PREFERRED EMBODIMENT

Figure 1:
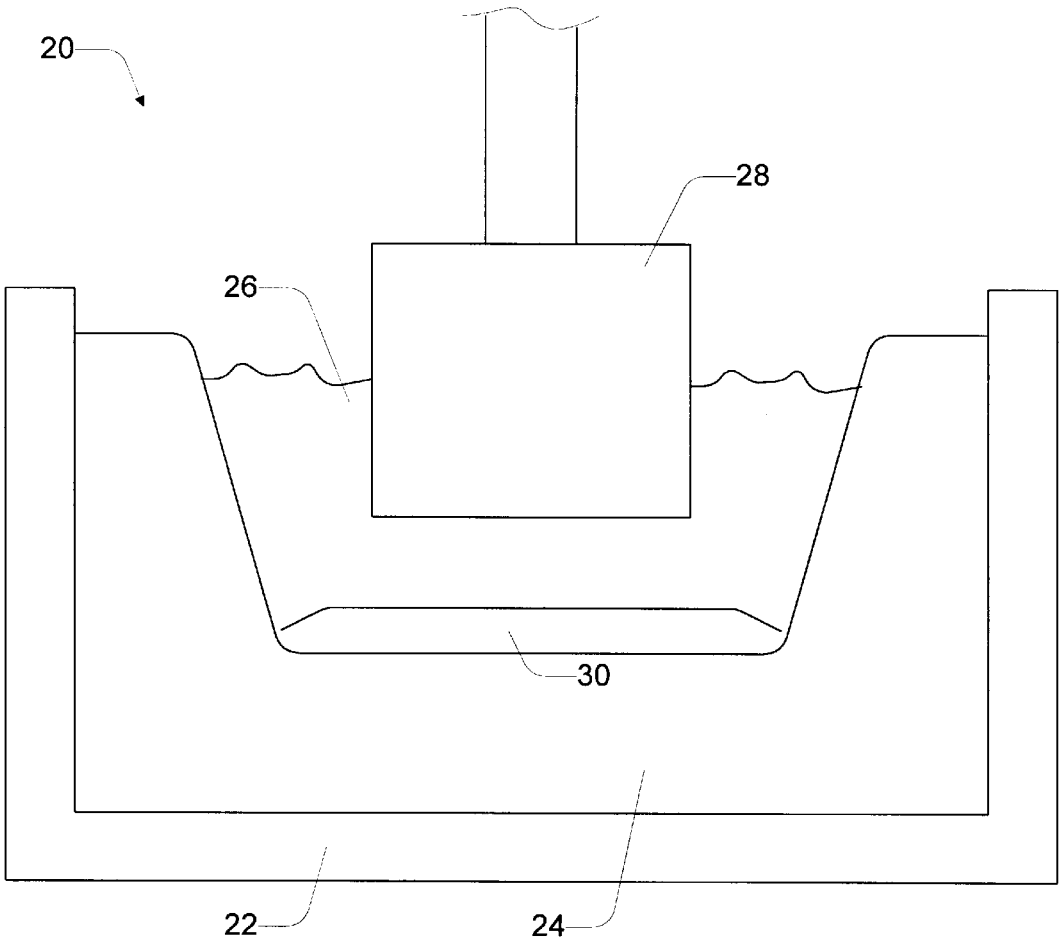
Fig. 1 Prior Art
FIG. 1 is a diagrammatic illustration of a prior art aluminum reduction cell.
Figure 2:
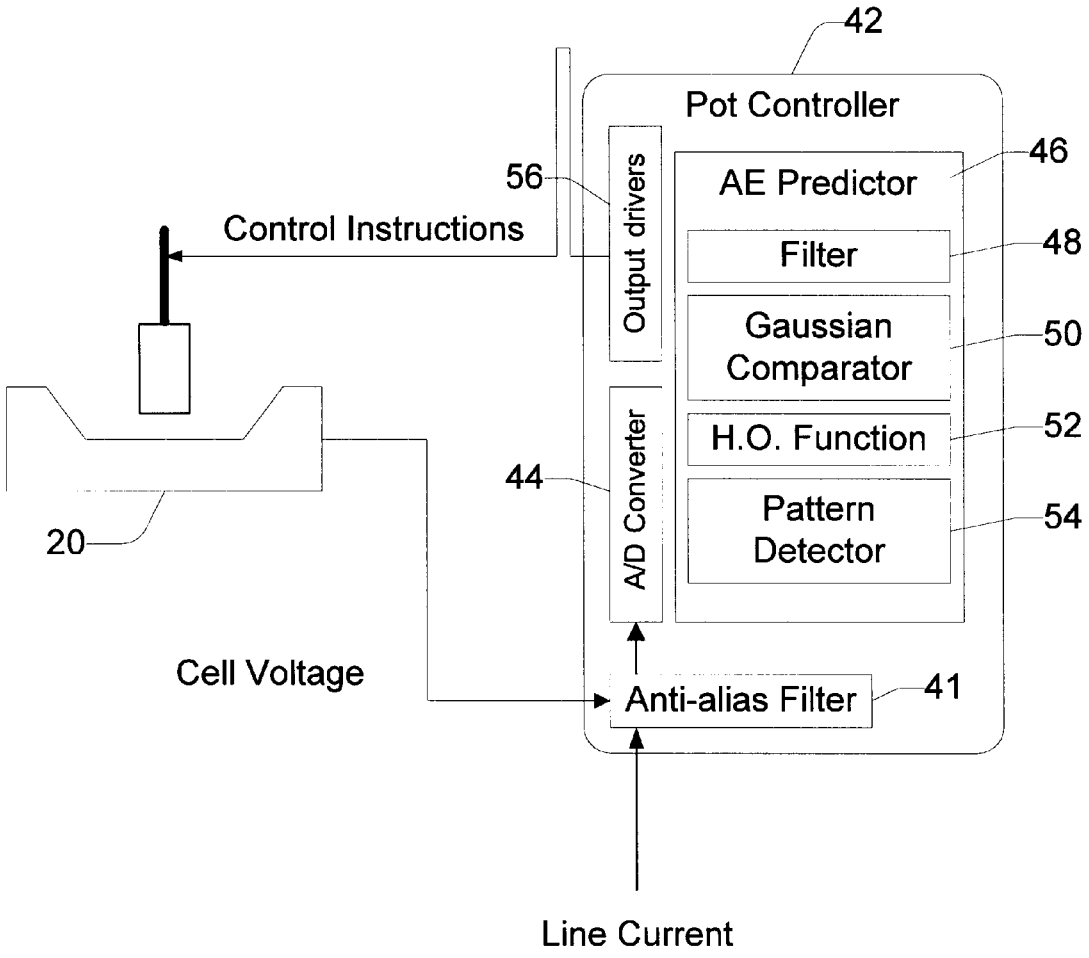
FIG. 2 is a diagrammatic illustration of an aluminum reduction cell system having a cell and a cell controller configured to predict an impending anode effect for the cell.

FIG. 2 shows an aluminum reduction cell system 40 comprising a cell controller 42 to monitor and control an associated aluminum reduction cell 20. The cell controller 42 receives an analog cell voltage signal from the cell 20 and an analog line current signal from the current bus to the serial array of cells. These signals are first bandwidth limited by applying an anti-aliasing low pass filter 41 to the analog signals prior to digital conversion. Preferably, this filter 41 should be of the Bessel type with a steep roll-off beyond its passband (8 to 12 poles). The cell controller 42 has an analog-to-digital converter 44 to convert the analog signals to digital data that can be rapidly processed by the cell controller. The cell controller 42 includes a memory to store the cell data and a processing unit to calculate impedance data from the measured cell voltage and line current.

The cell controller 42 relies on the cell data to generate control instructions for controlling operation of the cell 20. The control signals are generated by output drivers 56 to control such tasks as anode positioning and regulation of the alumina feed equipment.

The cell controller 42 has an anode effect predictor 46 that predicts when the aluminum reduction cell 20 is about to experience an anode effect. In general, the anode effect (AE) predictor 46 applies a higher-order statistical function to the cell impedance data to produce a higher-order spectrum representative of the cell's operating state. This spectrum changes as the cell transitions from steady state to an anode effect condition. That is, the spectrum exhibits different patterns depending upon whether the cell is operating in steady state, or is about to experience an anode effect. The anode effect predictor 46 detects the changing spectra as a means for predicting an oncoming anode effect.

The anode effect predictor 46 includes a filter 48, a Gaussian comparator 50, a higher-order function calculator 52, and a pattern detector 54. In a preferred embodiment, the anode effect predictor is implemented in software that is stored in memory and executed on the processor at the cell controller 42. A more detailed discussion of the cell controller is provided below with reference to FIG. 10.

Figure 3:
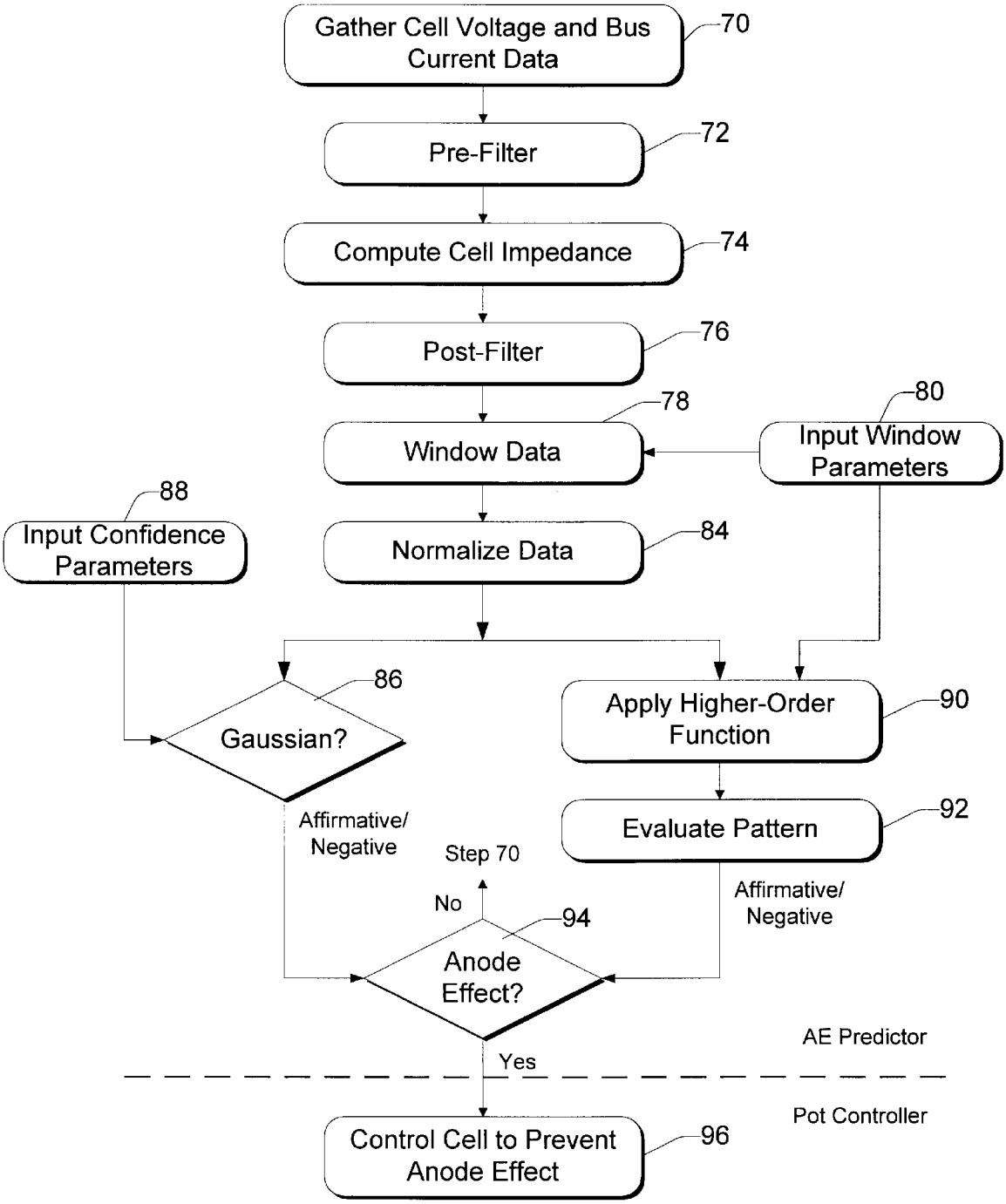
FIG. 3 is a flow diagram showing steps in a method for predicting an impending anode effect.

FIG. 3 shows steps in a method for predicting an impending anode effect. The steps are described with reference to the cell controller 42 in FIG. 2. The AE predictor 46 performs the steps in FIG. 3, with the exception of the last step 96. The cell controller 42 performs the last step 96. At step 70, the AE predictor 46 gathers the cell voltage and bus current data. The analog voltage and current signals are passed through anti-aliasing filter 41 and converted to digital data by A/D converter 44. The cell data output by A/D converter 44 is in the form of two time series of sampled data: a time series of cell voltage data and a time series of line current data. The cell data is stored in memory at the cell controller 42 and the AE predictor 46 accesses this memory to retrieve the data for analysis.

At step 72, the cell data is passed through a low-pass filter 48. Preferably, a linear phase FIR (finite impulse response) filter is employed because it provides an approximately constant group delay in the pass band that preserves temporal relationships of the components of the filtered signal. The phase characteristics of the low-pass filter 48 and the analog low-pass filter 41 in FIG. 2 help facilitate the anode effect prediction method described herein because the phase coupling information of spectral components is preserved in the higher-order spectra. Conventional spectral measurements based on second-order statistics, such as the power spectrum, do not reveal any relationship between the components of the spectrum. Next, at step 74, the AE predictor 46 computes a time series of cell impedance data from the voltage and current samples. The cell impedance data is also passed through a low-pass filter 48, which again is preferably a linear phase FIR filter (step 76).

At step 78, a sliding window function subsets the cell impedance data into blocks of samples (e.g., 1,000 samples). The window function is initiated to a default window, such as a Hamming window. Over time, the window is altered and modified based on a set of windowing parameters input by an administrator (step 80). The windowing parameters effectively add or modify weighting characteristics included in the windowing function. Each windowed block of cell impedance data is then normalized to a zero mean (step 84).

The AE predictor 46 utilizes two independent techniques for detecting an anode effect in an effort to increase the confidence of such a prediction. Both techniques essentially determine a degree of change in the gas bubble population statistics at the surface of the carbon anode in the cell 20. The first technique involves a Gaussian analysis. At step 86 in FIG. 3, the Gaussian comparator 50 in the AE predictor 46 examines the normalized cell impedance data to detect any divergence from a typical Gaussian distribution for normal operation of the cell 20. The Gaussian comparator 50 makes the examination using a set of confidence parameters input by the administrator (step 88). The confidence parameters are determined from manual observation of the particular cell 20 and derivation of values that explain what "normal" operation means for that cell.

If the comparator 50 finds that the divergence from normal Gaussian exceeds a preset tolerance range, the comparator 50 returns an affirmative result indicating that the cell 20 appears headed for an anode effect condition. Conversely, if the comparator 50 determines that any deviation from normal is within a tolerance range, the comparator 50 returns a negative result indicating that the cell 20 is not headed for an anode effect condition.

The second technique for detecting an anode effect involves higher-order statistical analysis of the cell data. At step 90, the AE predictor 46 applies a higher-order statistical function 52 to the normalized impedance data. The term "higher-order" is understood to mean third-order or higher. As one exemplary technique, the higher-order function 52 estimates a third-order coherence of the cell impedance data. The third-order coherence function, sometimes referred to as the "bicoherence" function, reveals not only the presence of spectral components in the cell impedance signal, but also the degree of coupling between these spectral components.

The bispectrum is related to the power spectrum in the following way. The power spectrum of a source signal can be estimated by first computing the autocorrelation sequence of the sampled signal, then transforming this sequence to the frequency domain by means of the discrete Fourier transform; thus the power spectrum is a second-order measure.

In so doing, the energy content information of the source signal for each spectral component is preserved, but the temporal relationships between these components and the degree of coupling between these components, inherent in the process that produced the source signal, are lost. This loss of coupling information in the autocorrelation sequence, and other second-order statistics, is well known in the signal processing community and has been extensively explored in the signal processing literature. The bispectrum of a source signal can be estimated by first estimating the third-order cumulant matrix of the sampled signal, then transforming this matrix to the frequency domain by means of the two-dimensional discrete Fourier transform. Thus, the bispectrum is a third-order measure. In so doing, all of the information in the power spectrum, as well as spectral component coupling information, is preserved. The bicoherence function is simply a normalized function of the bispectrum.

There are many different methods for estimating bicoherence, including both direct and indirect estimation techniques. Among these methods are parametric estimation, cumulant sequences and their transforms, and moment sequences and their transforms. These methods are well known and thus, are not described in detail.

As a result of step 90, the bicoherence function 52 produces a spectrum that is representative of cell behavior. Depending upon the operational state of the cell (i.e., steady state, anode effect, etc.), the spectrum exhibits different patterns. Examples of different patterns are discussed below with reference to FIGS. 4–9. At step 92, the pattern detector 54 in the AE predictor 46 evaluates the spectrum to determine whether its pattern is changing from a pattern associated with normal cell operation to a pattern associated with a cell operating in an anode effect condition.

There are many ways to implement the pattern detector 54. One approach is to employ a neural network that is initially configured with a default spectrum pattern representative of a typical transition to an impending anode effect. However, because each cell is different from the other, the neural network adapts the default pattern to more closely identify an impending anode effect as it occurs at the particular cell. Another approach is to implement the pattern detector 54 as pattern comparator that compares the spectrum produced by the higher-order coherence function with one or more footprints stored in memory at the cell controller.

The pattern detector 54 outputs an affirmative result if the spectrum pattern matches a pattern known to indicate an impending anode effect, and a negative result if the patterns do not match. It is also noted that the pattern detector can analyze the spectrum pattern in light of a "normal" pattern that reflects steady state operation of the cell, rather than the pattern indicating an impending anode effect.

At step 94, the anode effect predictor 46 decides whether the cell is approaching an anode effect condition based on the results from the two independent prediction paths. If both the Gaussian method and the statistical method yield affirmative results, the AE predictor 46 concludes that there is an impending anode effect (i.e., the "yes" branch from step 94). The AE predictor 46 then informs the cell controller 42 of the impending anode effect. The cell controller initiates procedures to prevent the AE condition or otherwise reduce its effect (step 96). An exemplary set of procedures include starting feed control to rapidly inject successive doses of alumina into the cell and then lowering the carbon anode to facilitate better mixing of the cryolitic bath.

Figure 4:
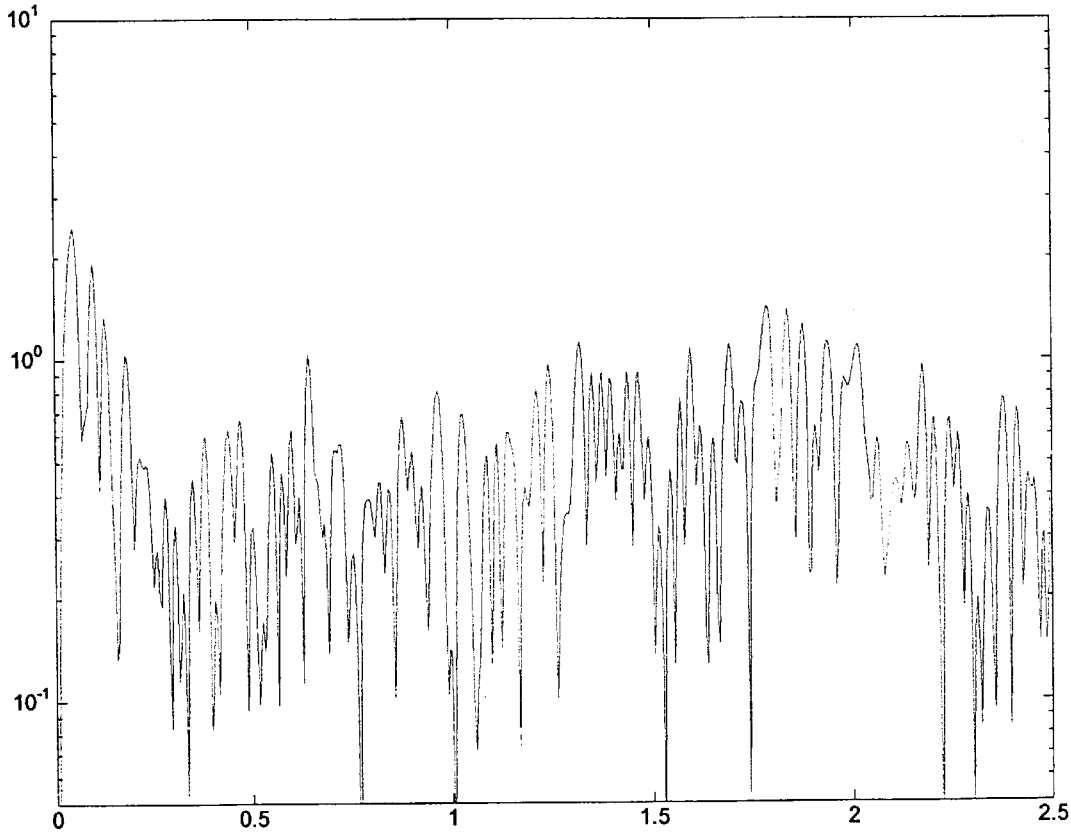
FIG. 4 is a plot of a power spectrum measured ten minutes before an anode effect occurs.
Figure 5:
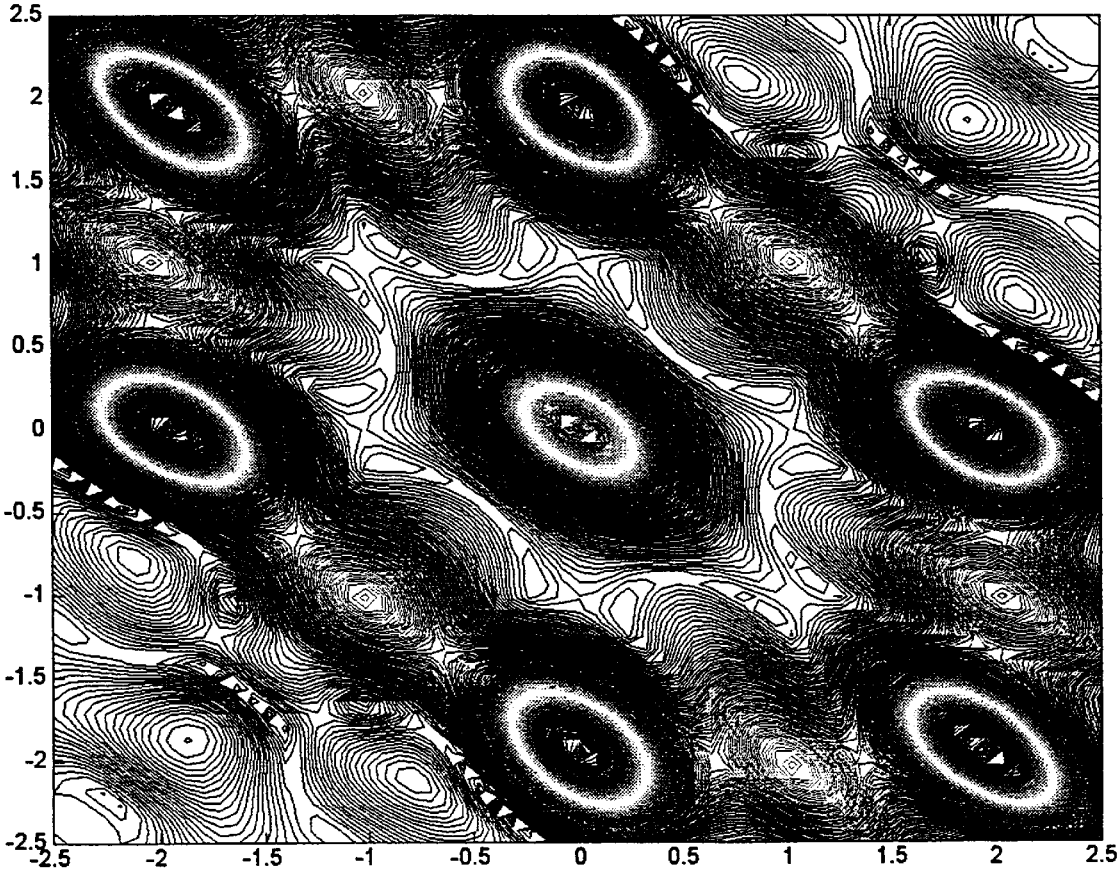
FIG. 5 is a plot of a two-dimensional Fourier transform of a third-order cumulant function of the data used to produce the power spectrum of FIG. 4.
Figure 6:
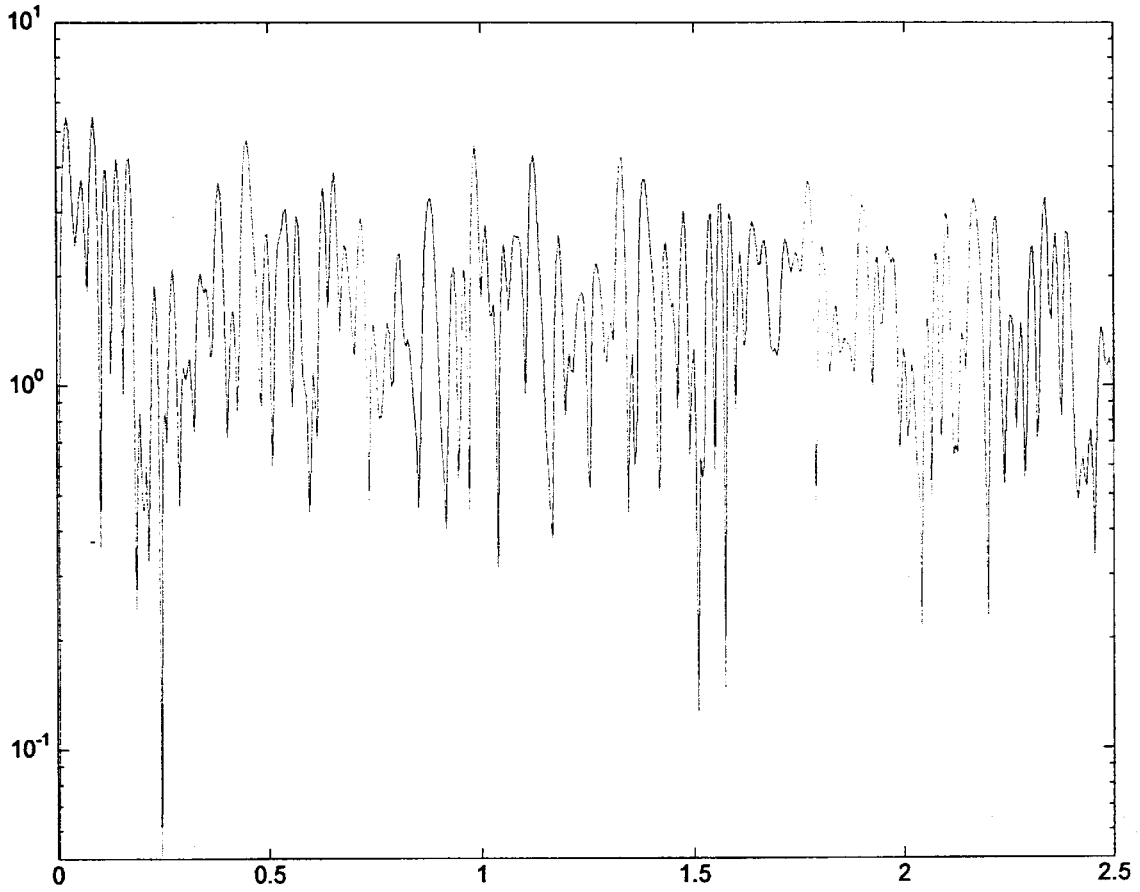
FIG. 6 is a plot of a power spectrum measured three minutes before an anode effect occurs.
Figure 7:
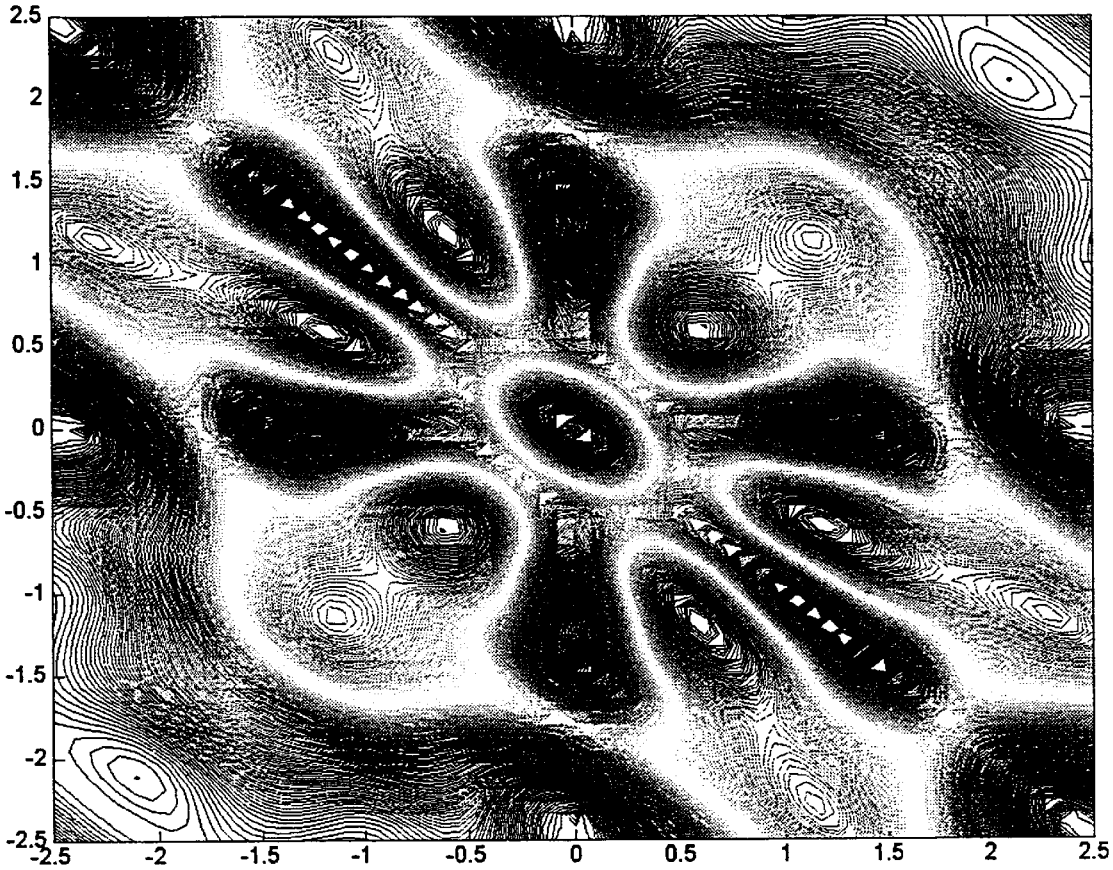
FIG. 7 is a plot of a two-dimensional Fourier transform of a third-order cumulant function of the data used to produce the power spectrum of FIG. 6.
Figure 8:
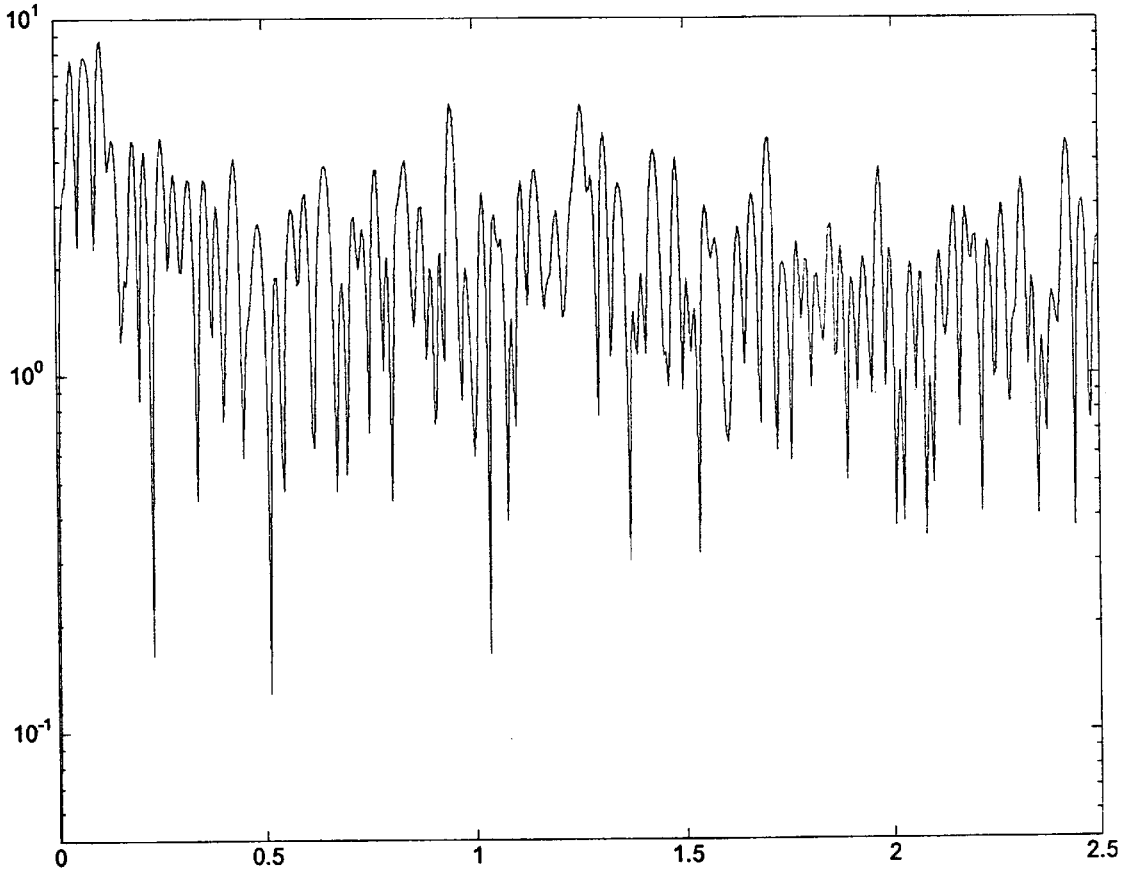
FIG. 8 is a plot of a power spectrum measured ninety seconds before an anode effect occurs.
Figure 9:
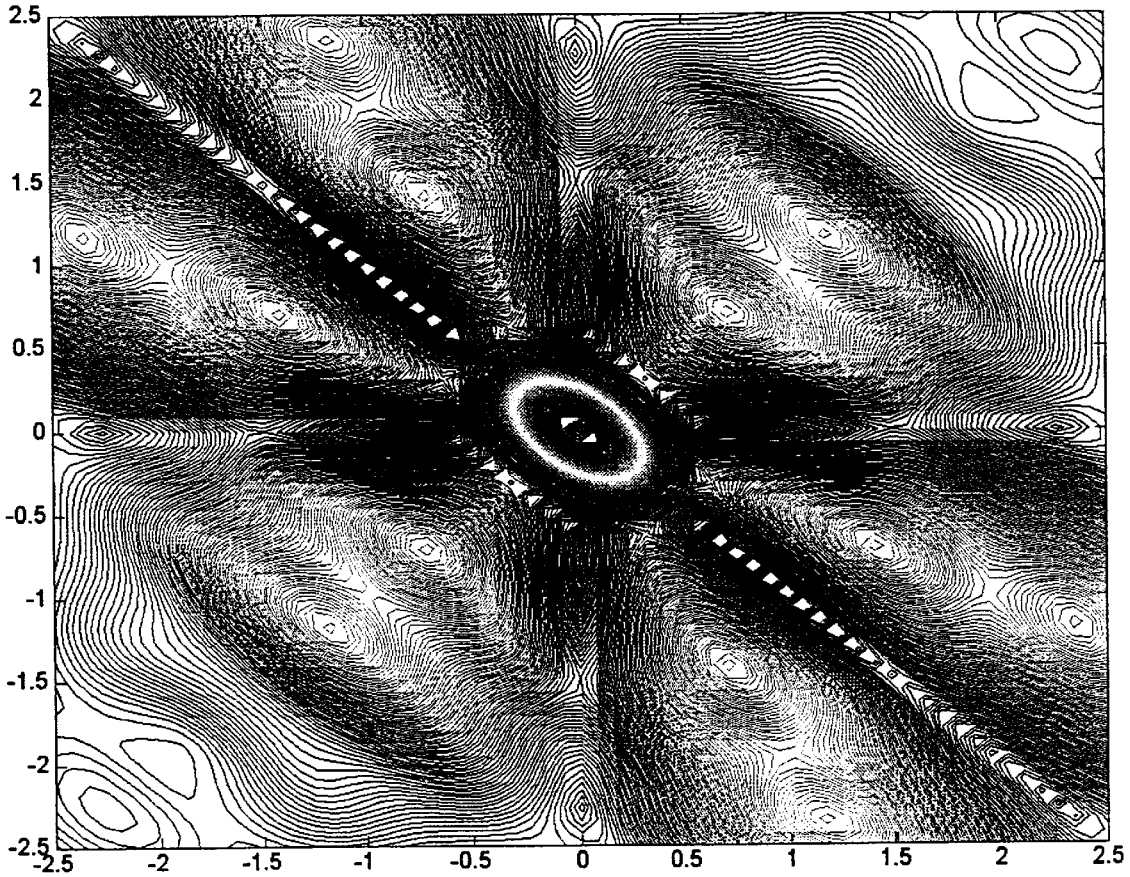
FIG. 9 is a plot of a two-dimensional Fourier transform of a third-order cumulant function of the data used to produce the power spectrum of FIG. 8.

FIGS. 4–9 illustrate changing spectrum patterns as the cell transitions from steady state operation to a state of impending anode effect. The plots shown in these figures were derived from three sets of measured cell data, which were taken in 40 second intervals at three different times leading up to an anode effect. FIGS. 4, 6, and 8 show the power spectrum for the cell, at ten minutes, three minutes, and ninety seconds prior to anode effect, respectively. FIGS. 5, 7, and 9 show the third-order spectrum patterns computed from the corresponding time series in FIGS. 4, 6, and 8, respectively. More particularly, these plots represent a two-dimensional Fourier transform of a third-order cumulant sequence of the corresponding time series.

FIGS. 4 and 5 were produced using data taken ten minutes prior to anode effect, and hence represent a cell operating in steady state. While the power spectrum in FIG. 4 appears to be random, its associated FIG. 5 plot of the higher-order coherence function produces an identifiable "ring" pattern. Notice that one concentration of energy occurs at low frequency (i.e., the center of the plot) and a fairly even distribution of six energy concentrations occurs in a ring about the center. This is a consequence of the twelve-sector symmetry inherent in the bispectrum, and is not due to any particular feature of the reduction cell signals.

FIGS. 6 and 7 were produced using a 40 second interval of data taken approximately three minutes prior to anode effect. These plots show a cell that is transitioning toward an anode effect condition. Notice that the power spectrum of FIG. 6 is still random, with slight changes in magnitude from the power spectrum of FIG. 4. However, the power spectrum still offers no reliable way to predict this transition to anode effect. However, the associated third-order spectrum plot of FIG. 7 shows a unique "star" pattern that is substantially different from the "ring" pattern of FIG. 5. Notice that the energy concentrations are migrating toward the low-frequency center.

FIGS. 8 and 9 were produced using a 40 second interval of data taken approximately ninety seconds prior to anode effect. These plots exhibit an impending anode effect. Notice that the power spectrum of FIG. 8 remains random, with slight changes in magnitude, and still offers no reliable way to predict the impending anode effect. The third-order coherence plot in FIG. 9, on the other hand, shows a new pattern where all of the energy is now concentrated in the low-frequency center. This pattern is very different from the steady state "ring" pattern of FIG. 5 or the transitioning "star" pattern of FIG. 7. The pattern detector 54 in the AE predictor 46 recognizes the change in patterns to predict the onset of an anode effect.

It is noted that the actual patterns that are observed in any given cell may vary from cell to cell. However, within each given cell, there is a transition from a normal steady state pattern to an anode effect pattern. Once the predictor is configured to recognize this transition for the given cell, the predictor can accurately discern when an anode effect is about to occur from these changing third-order patterns.

It is believed that the higher-order statistical analysis is an effective predictor of anode effects because they foretell a changing interdependence of the bubble generation and shedding processes at the anode surface as the cell transitions from steady state to an anode condition. Cell voltage is directly related s to, among other factors, the instantaneous anode surface area that is exposed to the electrolytic bath, and not covered by gas bubbles. Under nominally steady state electrolysis conditions, a very large number of very small carbon dioxide ($CO_2$) bubbles are produced. These $CO_2$ bubbles do not wet the anode surface, and so are quickly shed from the anode surface by hydrodynamic forces. As a result, the bubbles tend not to interact with each other.

As an anode effect condition begins to occur and the anion population is not replenished at a sufficient rate, larger fluorocarbon gas bubbles begin to form at the anode surface. These fluorocarbon gas bubbles wet the anode surface, and tend to remain on the anode surface for longer periods compared to carbon dioxide bubbles. The fluorocarbon bubbles may even coalesce with other bubbles before they are eventually shed, thereby prolonging their stay at the anode surface. The changing bubble behavior affects the measured cell voltage signal. It is believed that the probability density of the small voltage variations due to bubble formation and shedding is consistent with the probability density of the bubble population.

The evolving bubble population is revealed in the statistical analysis of the measured cell voltage (or computed cell impedance). For this reason, the AE predictor 46 that applies a higher-order coherence function to the measured cell voltage or impedance signal provides an accurate predictor of impending anode effects.

The anode effect predictor 46 can be implemented in many different ways, including as a software module loaded in a computer, as a hardware component with embedded firmware, and the like. As shown in FIG. 2, however, one preferred implementation is to incorporate the anode effect predictor into a cell controller that controls an associated cell. One exemplary cell controller is manufactured and sold by Kaiser Chemical and Aluminum Company under the trademark "CELTROL".

Figure 10:
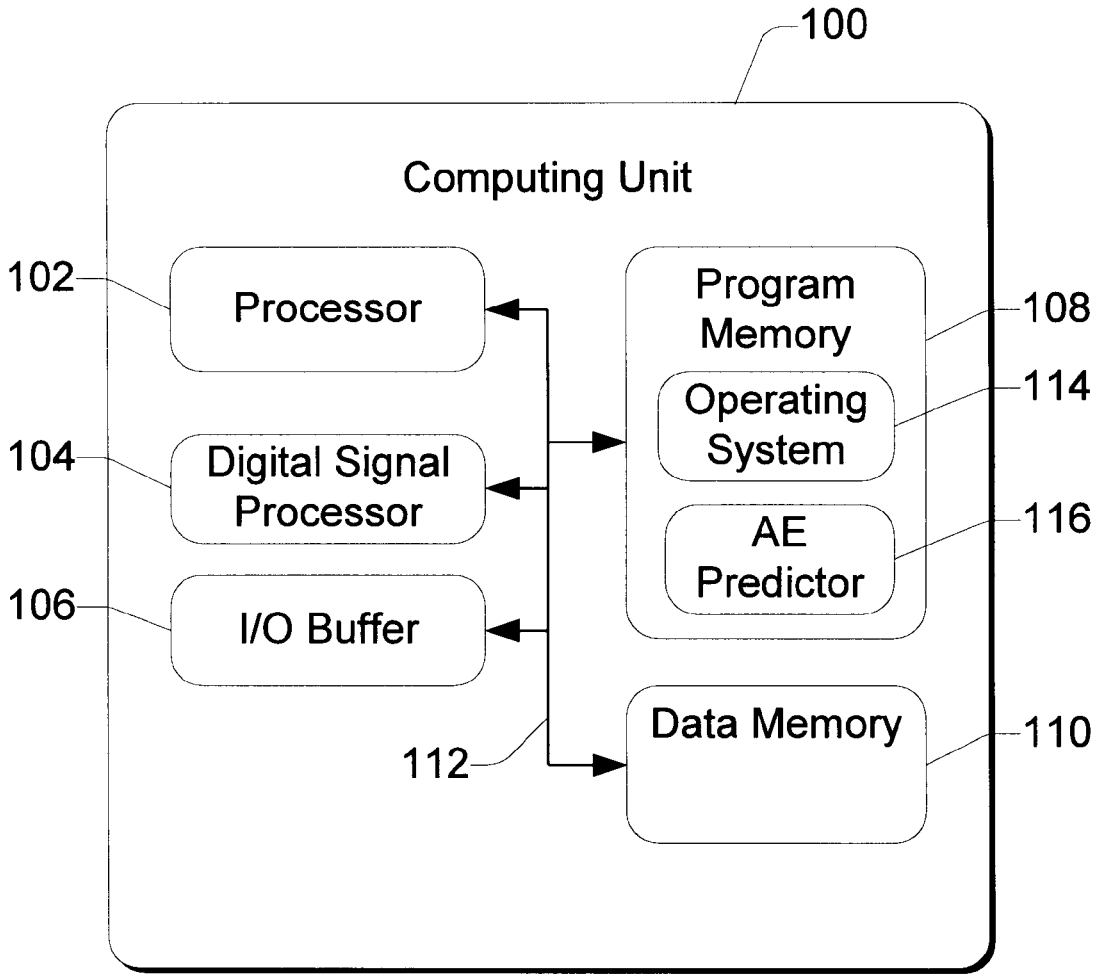
FIG. 10 is a block diagram of a computing unit that implements the anode effect predictor according to one implementation.

FIG. 10 shows an exemplary construction of a computing unit 100 that implements the anode effect predictor 46. As one possible implementation, the computing unit 100 can be incorporated into a cell controller, such as the "CELTROL" cell controller. The computing unit 100 has a processor 102, a digital signal processor (DSP) 104, an I/O interface 106, program memory 108 (e.g., ROM, flash, disk, etc.), and data memory 110 (e.g., RAM, disk, etc.). These components are interconnected via a bussing structure 112, including parallel and serial communications interfaces. The computing unit 100 optionally runs an operating system 114 that is stored in program memory 108 and executed on the processor 102.

The anode effect predictor 46 is shown implemented as software code stored in program memory 108. The anode effect predictor code is executed on the digital signal processor 104 to calculate the higher-order statistics and spectra. The AE predictor 46 includes the pattern detector 54 (e.g., a neural network pattern identifier), which is also executed on the DSP 104.

During operation, the I/O interface 106 receives the digital voltage and current data from the anti-aliasing filter 41 and stores it in data memory 110. The processor executes one or more routines (not shown) to filter the voltage and current data and to compute the cell impedance data. The AE predictor 46 is then loaded into DSP 104 and executed to process the impedance data. The AE predictor 46 applies a higher-order statistical function to the cell impedance data to produce a higher-order spectrum representative of the cell's operating state. The neural networks identify the changing spectra as a means for predicting an oncoming anode effect.

Although the invention has been described in language specific to structural features and/or methodological steps, it is to be understood that the invention defined in the appended claims is not necessarily limited to the specific features or steps described. Rather, the specific features and steps are disclosed as exemplary forms of implementing the claimed invention.

What is claimed is:

1. A system for predicting an impending anode effect in an aluminum reduction cell, comprising:

a controller to measure cell signals over time to form time series of cell signals; and a predictor to sample the time series of cell signals to produce cell data and to apply a higher-order statistical function to the sampled cell data to produce a spectrum representative of cell behavior, the predictor determining when an anode effect is impending from changes in the spectrum.

2. A system as recited in claim 1, wherein the controller is configured to measure a cell voltage signal and a cell impedance signal.

3. A system as recited in claim 1, wherein the predictor is configured to apply a higher-order coherence function to the sampled cell data.

4. A system as recited in claim 1, wherein the predictor is configured to apply a third-order statistical function to the sampled cell data.

5. A system as recited in claim 1, wherein the predictor includes a neural network unit that detects when the spectrum is changing patterns.

6. A system as recited in claim 1, wherein the predictor is configured to compare the spectrum to a pre-established footprint that indicates a transitioning to the anode effect.

7. A system as recited in claim 1, wherein the cell signals exhibit a steady-state Gaussian behavior when the cell is operating normally, and the predictor is configured to analyze deviation of the cell signals from a steady-state Gaussian behavior as a way to detect an impending anode effect.

8. A system as recited in claim 1, wherein the controller is configured to generate control instructions to control operation of the aluminum reduction cell to reduce the impact on the aluminum reduction cell as a result of the anode effect.

9. A system as recited in claim 1, wherein the controller is configured to generate control instructions to control operation of the aluminum reduction cell to prevent the impending anode effect.

10. A system as recited in claim 1, further comprising a mechanism to warn an operator of the impending anode effect.

11. A system for predicting an impending anode effect in an aluminum reduction cell, comprising:

a controller to measure cell signals over time to form a time series of cell signals; and a predictor to sample the time series of cell signals to produce cell data and to analyze whether the cell data resembles a Gaussian distribution indicative of steady state operation, the predictor determining that an anode effect is impending when the cell data varies from the Gaussian distribution.

12. A system as recited in claim 11, wherein the predictor is configured to apply a higher-order statistical function to the sampled cell data to produce a spectrum representative of cell behavior, the predictor also being configured to evaluate changes in the spectrum as a second way of determining when an anode effect is impending.

13. A system as recited in claim 11, wherein the controller is configured to generate control instructions to control operation of the aluminum reduction cell to reduce the impact on the aluminum reduction cell as a result of the anode effect.

14. A system as recited in claim 11, wherein the controller is configured to generate control instructions to control operation of the aluminum reduction cell to prevent the impending anode effect.

* * * * *